United States Patent [19]

Ling

[11] 4,398,779

[45] Aug. 16, 1983

[54] KEYING APPARATUS FOR INTERCONNECTING ELECTRICAL COMPONENTS

[75] Inventor: Dean D. Ling, Blacklick, Ohio

[73] Assignee: Bell Telephone Laboratories, Incorporated, Murray Hill, N.J.

[21] Appl. No.: 217,708

[22] Filed: Dec. 18, 1980

[51] Int. Cl.[3] ..... H01R 13/64

[52] U.S. Cl. ..... 339/17 LC; 339/186 M

[58] Field of Search ..... 339/17 LC, 17 LM, 184 R, 339/184 M, 185, 186 R, 186 M

[56] References Cited

U.S. PATENT DOCUMENTS

| | | | |
|---|---|---|---|
| 1,633,827 | 6/1927 | Siegel | 339/66 M |
| 2,047,384 | 6/1936 | Richterkessing | 339/185 R |
| 3,474,395 | 10/1969 | Ferdon et al. | 339/186 M |
| 3,634,816 | 1/1972 | Zell | 339/186 M |
| 3,729,657 | 4/1973 | Callan et al. | 339/186 M |
| 3,836,935 | 9/1974 | Johnson | 339/17 LM |
| 3,963,301 | 6/1976 | Stark | 339/186 M |

FOREIGN PATENT DOCUMENTS

| | | | |
|---|---|---|---|
| 2806762 | 8/1979 | Fed. Rep. of Germany | 339/186 M |

*Primary Examiner*—Neil Abrams

*Attorney, Agent, or Firm*—W. H. Kamstra

[57] ABSTRACT

Apparatus for ensuring the proper interconnection of an electrical component (11) and the terminal pins (15) of a backplane (10). A keying member (14) having a pair of dowels (26, 27) at a predetermined spacing uniquely selected from a plurality of possible spacings ($a_1$–$a_4$; $b_1$–$b_4$) is associated with an array of pins (15) to which connection is to be made. The component (11) presents a vertical plate, the leading edge of which is notched (40, 42) to correspond to the dowel spacing so that, as the component is fitted to the pin array, the dowels (26, 27) freely enter the notches (40, 42). A connector block (34) and a stiffener member (38) on opposite sides of the plate are fluted (43, 44) to correspond to the plurality of possible spacings and to present possible cylindrical holes thereat, completed cylindrical holes being presented only where the plate is correspondingly notched. Polarization is achieved by avoiding a symmetrical spacing of the dowels along the keying member.

11 Claims, 5 Drawing Figures

34
36

20
33
39
11
43
35
37
38
43
39
40
37
48
47
50
49
44
39
41
43
44
51
35
43
39
37
44
36
33
42
44

KEYING APPARATUS FOR INTERCONNECTING ELECTRICAL COMPONENTS

TECHNICAL FIELD

This invention relates to apparatus for electrically interconnecting electrical components and the like and particularly to keying apparatus for ensuring the correctness of such interconnections.

BACKGROUND OF THE INVENTION

The need for providing mounting and interconnection arrangements for the various components and equipment of large scale communication and electronic systems is well known. Components such as circuit packs, printed wiring boards, and the like are physically mounted and electrically interconnected in a manner to facilitate their initial installation and subsequent access for testing, maintenance, and replacement when necessary, for example. One well-known arrangement provides a backplane having large fields of terminal pins extending therethrough to which electrical interconnections between components may be made on either side. On one side, an array of circuit boards, for example, may be mounted in suitable racks and frames and connected to particular arrays of the pins with the other ends of the pins being connected to cabling for electrical interconnections between components. The backplane itself normally also presents printed wiring for making particular electrical connections between terminal pins. Whatever the form of the component mounting arrangements, it will be appreciated that some provision must be made to ensure that the right component is mated with the correct array of backplane pins and, further, that the component is properly polarized with respect to its corresponding pin array. To these ends, a number of coding or keying arrangements have in the past been proposed. One such arrangement is disclosed, for example, in the patent of D. R. Zell, U.S. Pat. No. 3,634,816, issued Jan. 11, 1972, which comprises a pedestal or protrusion extending from a circuit board edge which protrusion is adapted for insertion in a receptacle of a connector. A plurality of stamped inserts are provided which may be selectively fitted about the protrusion in various combinations to fit only in corresponding contours of the connector receptacle. Only one insert combination and thus only a particular circuit board can be mated with a connector. In this arrangement, polarizing, that is, ensuring that the circuit board is not reversed with respect to its connector, may be accomplished by tabs at the ends of the board and connector which mate only with corresponding grooves in the two elements. Although this and other known keying arrangements may be practicable, a simpler and more readily assembled keying arrangement would not only enhance reliability but could achieve significant cost reduction. It is the achievement of these and other objectives to which the keying apparatus of the present invention is chiefly directed.

SUMMARY OF THE INVENTION

The objectives of the invention are achieved in one illustrative keying arrangement employed in conjunction with the mounting of a printed circuit board, for example, which arrangement comprises a keying element adapted to be fitted over an array of backplane terminal pins to which the circuit board is to be interconnected. The keying element has two or more dowels outwardly extending therefrom in the direction from which the circuit board is to be fitted. The two outer dowels are uniquely spaced from the ends of the keying element in accordance with the particular keying code assigned to the circuit board or component to be mounted. The circuit board is provided with notches on its leading edge which are spaced to admit only correspondingly spaced dowels of the keying element as the circuit board is mounted in its rack to fit its board edge connector to its proper terminal pin array. The surface of the latter connector facing the circuit board as well as a stiffener member on the other side of the board are fluted at each of the possible dowel positions so that at each notch position a cylindrical hole is presented dimensioned to slidably admit a keying element dowel. A central metallic dowel identically positioned on all keying elements may advantageously be provided to operate a contact spring in a corresponding flute of the connector surface to control power on when the circuit board is mounted. Polarizing of the keying function may advantageously be achieved by avoiding a symmetrical positioning of the outer dowels and corresponding circuit board notches.

BRIEF DESCRIPTION OF THE DRAWING

The organization and operation of a keying apparatus according to this invention together with its features will be better understood from a consideration of the detailed description of an illustrative embodiment thereof which follows when taken in conjunction with the accompanying drawing in which.

DETAILED DESCRIPTION

Figure 1:
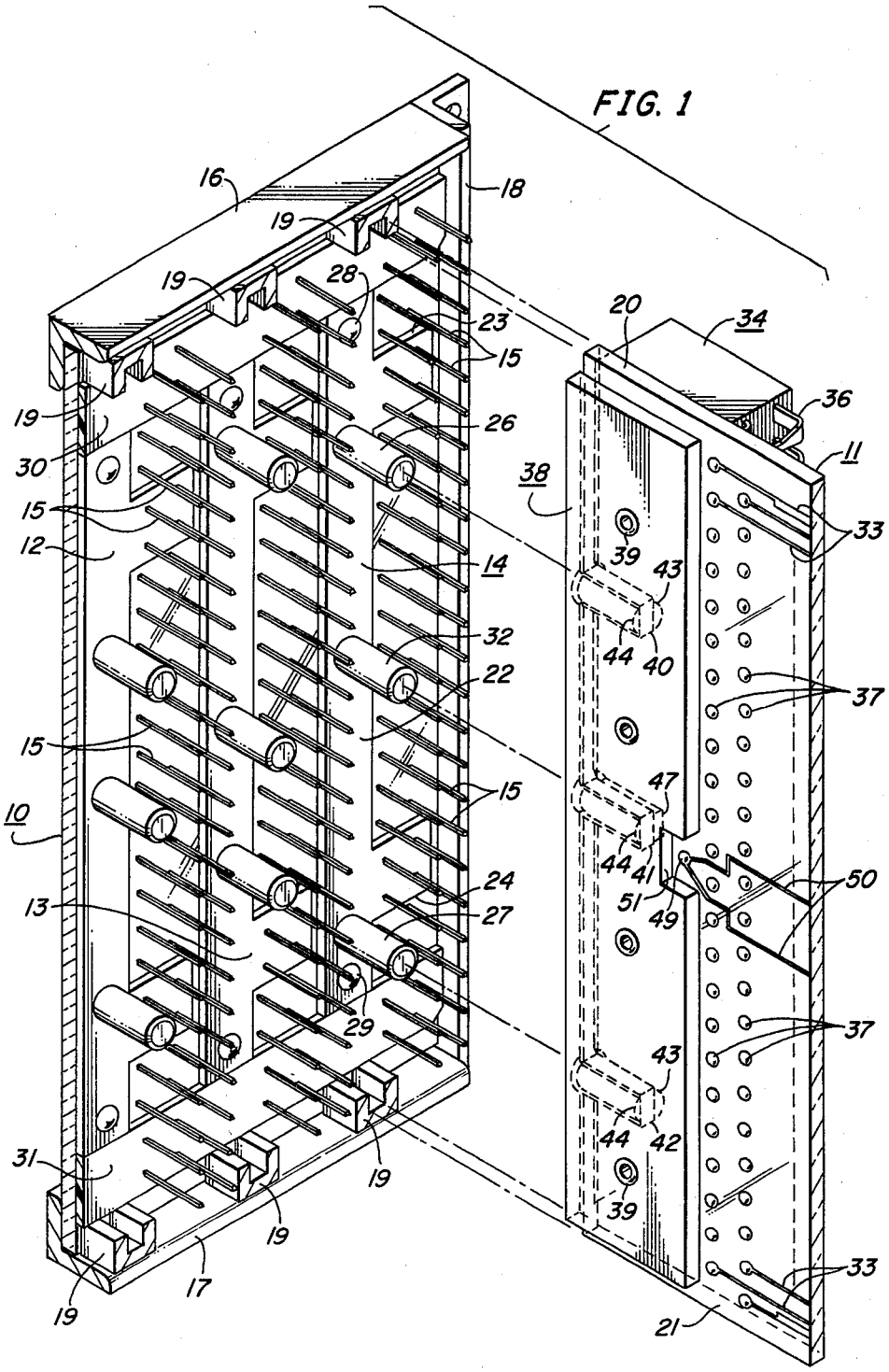
FIG. 1 depicts in perspective view a portion of a backplane presenting arrays of terminal pins and a portion of a circuit board in alignment with and preparatory to its fitting to an array of the pins.
Figure 2:
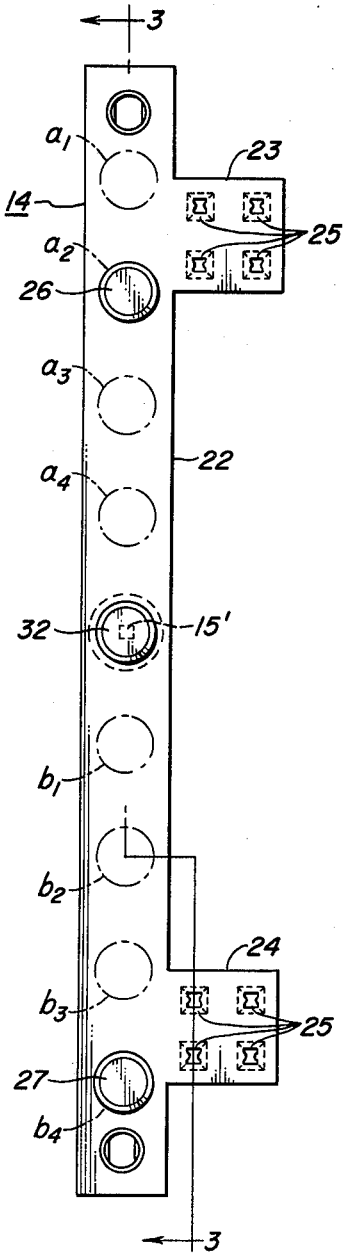
FIG. 2 is a plan view of a keying element according to the invention.
Figure 3:
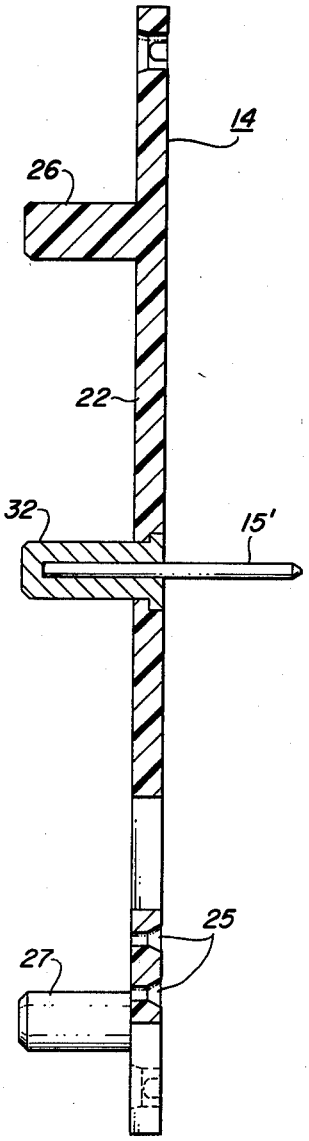
FIG. 3 is a cross-sectional view of the keying element of FIG. 2 taken along the line 3—3.

An illustrative keying apparatus according to the principles of the invention is shown in connection with a portion of typical backplane 10 and a portion of an unassembled circuit board 11, the backplane keying members 12, 13, and 14 being shown in greater detail in FIGS. 2 and 3. Backplane 10 conventionally comprises an insulative board having arrays of terminal pins 15 extended therethrough to project outwardly from both sides of backplane 10. Pins 15 typically have compliant sections fitted in plated-through holes in plane 10, which platings normally are interconnected with other holes and pins by printed wiring, not shown, on a face of plane 10. Upper, lower, and side rails 16, 17, and 18 are provided for suitably mounting backplane 10 in system mounting frames. Extending outwardly from backplane 10 from its upper and lower rails 16 and 17 is a plurality of parallel and aligned "U" shaped channel guide rails 19, only portions of which are shown, adapted to receive the upper and lower edges 20 and 21 of board 11 as the latter is ultimately mated with the pins of backplane 10. A keying member according to the invention, which may be described in connection with member 14, comprises a vertically extending electrically insulative strip 22 (see also FIGS. 2 and 3) having a pair of tabs 23 and 24 near its ends and extending from one side. Tabs 23 and 24 have provided therein chamfered apertures 25 spaced to correspond to the spacings of pins 15 of backplane 10 to permit keying member 14 to fit over the latter pins to ensure its precise positioning with respect to circuit board 11. A first and a second electrically insulative dowel 26 and 27 are affixed or integrally formed with strip 22 near its extremities. Dowels 26 and 27 are uniquely spaced as will be considered hereinafter. After keying member 14 is fitted over pins 15, it is permanently affixed to the face of backplane 10 by any suitable means such as rivets 28 and 29. Spacer members 30 and 31 may be fitted over pins 15 at the upper and lower ends of backplane 10 between which keying members 12, 13, and 14 are mounted for additional alignment. An additional, electrically conductive dowel 32 is centrally mounted through keying member strip 22 and also extends, as shown in FIG. 1, toward the leading edge of circuit board 11.

Circuit board 11 typically has printed wiring 33 affixed to a surface thereof, representative ones of which are shown in the figure, which wiring may interconnect to circuit elements, not shown, also affixed to the board surface. On one side, board 11 has affixed thereto a connector block 34 (shown in FIG. 4 before assembly) which conventionally is provided with rows of receptacles, not shown, accessed by apertures 35 presented on its forward face. The receptacles are aligned with and adapted to receive, pins 15 of backplane 10 and present on the rearward face of connector 34 terminations 36 which are formed to make electrical connections with corresponding terminals 37 on circuit board 11 to which printing wiring 33 is connected. On the side of board 11 opposite to that of connector block 34 and running along its vertical edge is affixed a stiffener member 38 (shown in FIG. 4 before assembly). Connector block 34, circuit board 11, and stiffener member 38 may be rigidly held together as shown in FIG. 1 in any convenient manner known in the art such as by pins 39 molded on the face of connector block 34 extending through corresponding holes in the other members.

With the foregoing general organization of a circuit board and backplane assembly in mind, further specific details of a keying arrangement according to the invention, may now be considered. FIGS. 2 and 3 show plan and sectional views, respectively, of a keying member 14 having a metallic dowel 32 extending therefrom substantially centrally in every case. As represented in the view of FIG. 2, four equally spaced locations $a_1$, $a_2$, $a_3$, and $a_4$ and $b_1$, $b_2$, $b_3$, and $b_4$ above and below dowel 32 are possible for dowels 26 and 27, the latter being located at locations $a_2$ and $b_4$, respectively. In accordance with this unique location of dowels 26 and 27 and centrally located dowel 32, circuit board 20 (FIG. 4) has formed therein and extending inwardly from its edge, corresponding notches 40, 41, and 42 dimensioned to admit dowels 26, 32, and 27, respectively. Both connector block 34 and stiffener member 38 have formed in their opposing faces flutings 43 and 44, respectively, having radii slightly larger than those of dowels 26, 27, and 32 and spaced to correspond to possible dowel locations a and b on keying member 14. Upon assembly of connector block 34, circuit board 20, and stiffener member 38, substantially cylindrical holes are thus presented for dowels 26, 27, and 32, which holes are incomplete at other locations a and b due to the unnotched board 20 at the latter locations. Accordingly, board 20 (FIG. 1) can only be fitted over pins 15 at keying member 14. Circuit board 11, notched as described, would not be accepted, for example, by keying members 12 or 13, the keying dowels of these elements extending from locations $a_3$, $b_3$ and $a_1$, $b_2$, respectively. Polarizing of the keying arrangements, that is, ensuring that a connector block 34 can not be reverse fitted over pins 15 at a keying member, is readily achieved by avoiding a symmetrical location of the keying dowels on either side of central dowel 32. Thus, for any keying member, positioning of keying dowels at the same time at locations $a_1$, $b_4$; $a_2$, $b_3$; $a_3$, $b_2$; and $a_4$, $b_1$ is avoided. For the specific keying arrangement being described (FIG. 2), twelve unique, nonsymmetrical combinations of keying dowel locations are thus available for coding pin arrays and circuit boards. In order to facilitate entry of the keying dowels in a correct circuit board fitting and to prevent damage to the dowels and backplane terminal pins by an attempted erroneous fitting, the openings of flutings 43 and 44 are chamfered and the leading edge of circuit board 11 is set in from the faces of connector block 34 and stiffener number 38 a distance substantially equal to the depth of the chamfering. During an erroneous board fitting attempt, the slight insertion of the keying dowels to the unnotched board leading edge prevents any lateral movement of the board and its connector block and possible resulting pin bending and breakage.

Figure 4:
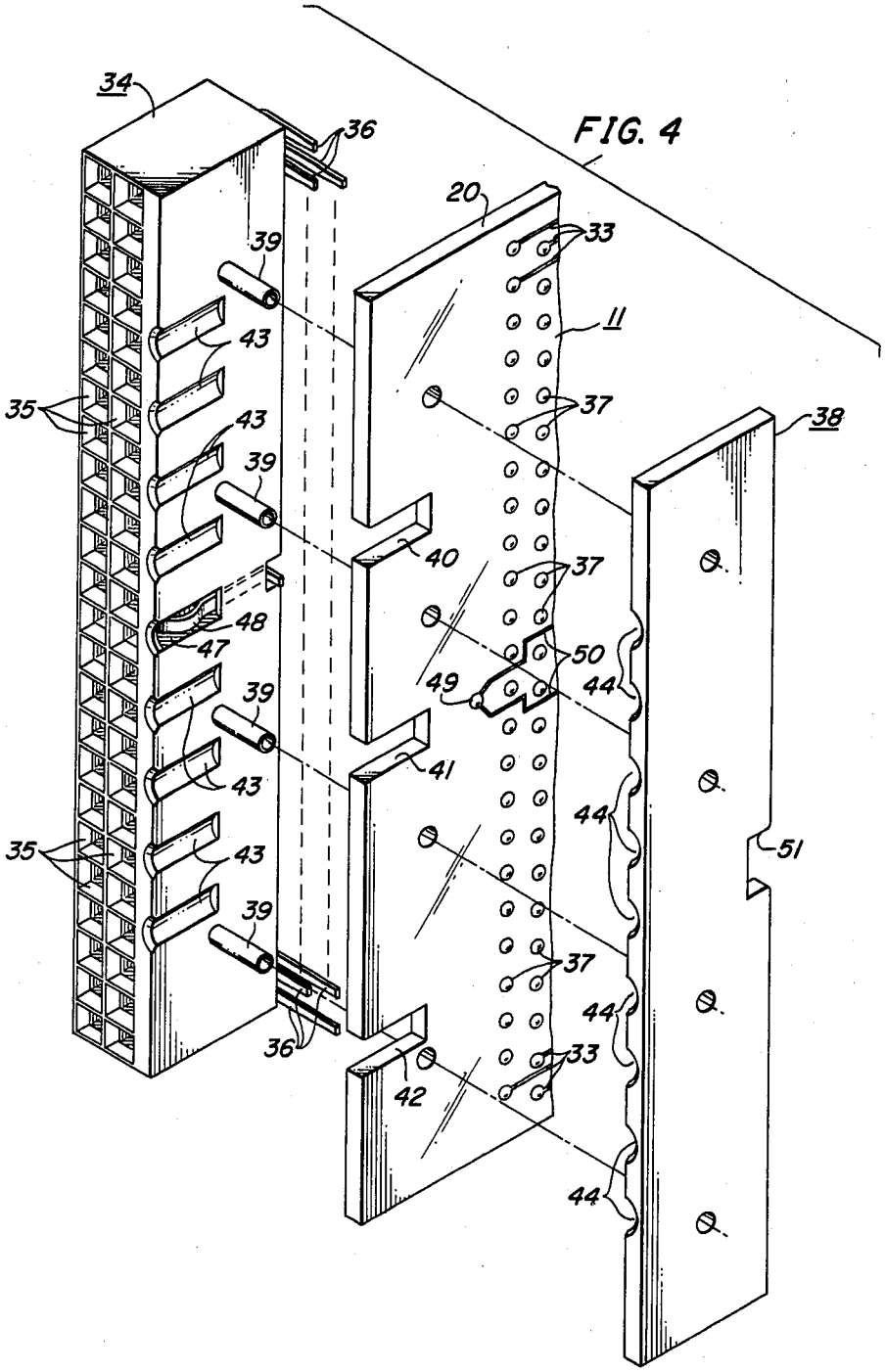
FIG. 4 is an exploded perspective view of the end portion of an electrical circuit board, its board edge connector, and the opposing side stiffener member showing the details of the keying arrangement according to the invention.
Figure 5:
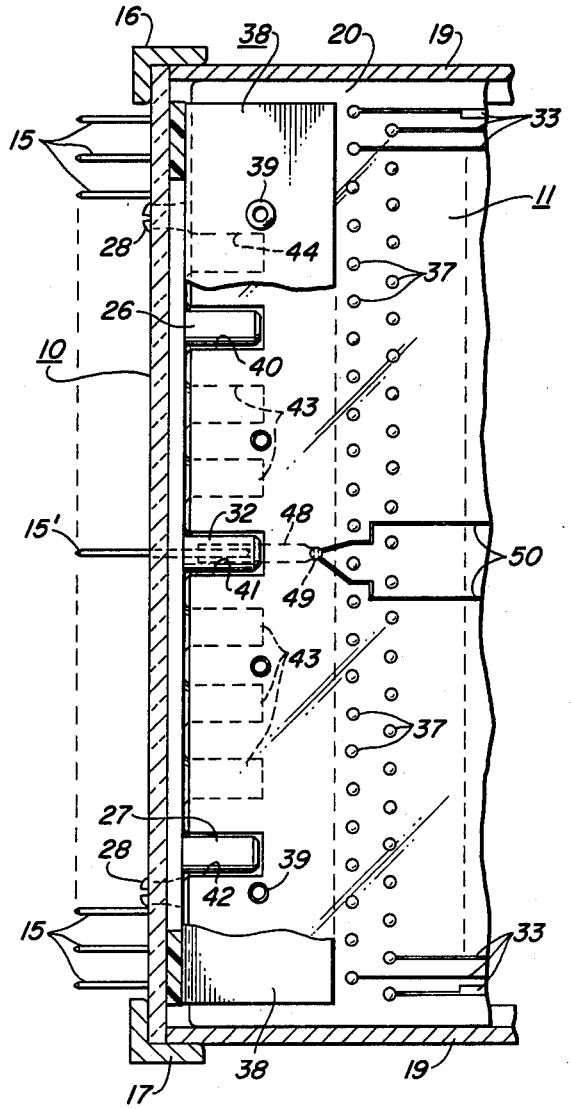
FIG. 5 is a partial cross-sectional side view of a backplane and a portion of a fully mounted circuit board showing the keying arrangement of the invention including the power control feature.

Another feature of a keying arrangement according to the invention is shown in detail in FIG. 3, 4 and 5. Electrically conductive, central dowel 32 extending through a keying member has electrically connected thereto a terminal pin 15' which in a final assembly, extends through backplane 10. Pin 15' in practice may advantageously be connected to a power source, not shown, for circuit board 11. Fluting 47 of connector block 34 for central dowel 32 is enlarged to accommodate a contact spring 48 having a contact surface extending into the partial cylindrical opening presented to dowel 32. Spring 48 is terminated in the manner of contact terminations 36 by electrical connection to a power terminal 49 on circuit board 11 from which power may be distributed to circuit board electrical components by wiring 50. When circuit board 11 is fully inserted between guide rails 19 and fitted to its pin array an electrical conducting path is completed between pin 15' and wiring 50 via dowel 32 and contact spring 48. Stiffener member 38 may be suitably notched as at 51 to accommodate terminal 49 and its associated wiring 50.

It will be appreciated that although an illustrative keying arrangement according to the invention was described in connection with the coding of an electrical circuit board, the invention is not so limited. Thus, for example, an entire electrical component such as a memory unit may as readily be coded in the manner described for unique connection to an array of terminal pins. What has been described is accordingly to be understood as constituting only one specific illustrative keying arrangement according to the invention in which various and numerous modifications may be devised by one skilled in the art without departing from the spirit and scope thereof as limited only by the accompanying claims.

What is claimed is:

1. In combination, an electrical component presenting a keying plate on at least one side, said plate having a first and an opposite, second face and a leading edge, and a connector block adapted to engage an array of backplane terminal pins said block having a surface abutting said first keying plate face, said plate having a first and a second notch formed inwardly from said leading edge, said notches being spaced and located at predetermined locations on said plate selected from a plurality of possible fixed locations on said plate, said notches being dimensioned to admit a first and a second dowel correspondingly spaced associated with said array of terminal pins, said surface of said connector block having flutings formed therein dimensioned to admit said dowels, said flutings being spaced to correspond to said plurality of possible fixed locations on said plate.

2. The combination as claimed in claim 1 in which said electrical component comprises an electrical circuit board.

3. Electrical interconnection apparatus comprising an array of terminal pins (15), a connector block (34) adapted to fit over said pins (15), and an electrical component (11) presenting a plate leading edge characterized in a keying member (12, 13, 14) associated with said array of terminal pins (15), said member (14) having a pair of dowels (26, 27) extending outwardly therefrom having a predetermined spacing uniquely selected from a plurality of possible spacings, in that said plate leading edge of said component (11) has a pair of notches (40, 42) formed therein spaced apart to correspond to said predetermined spacing of said pair of dowels (26, 27) and dimensioned to admit said last-mentioned dowels when said connector block (34) is fitted over said array of terminal pins (15), and in that said connector block (34) is formed to present a face in contact with one side of said component (11) plate and having a plurality of flutings (43) in said face dimensioned to admit said dowels (26, 27) and spaced to correspond to said plurality of possible spacings.

4. Electrical interconnection apparatus as claimed in claim 3 further characterized in a flat stiffener member (38) having a face in contact with the other side of said component (11) plate and having a plurality of flutings (44) dimensioned to admit said dowels (26, 27) and spaced to correspond to said plurality of possible spacings.

5. Electrical interconnection apparatus as claimed in claim 4 further characterized in that said electrical component (11) comprises an electrical circuit board.

6. Electrical interconnection apparatus as claimed in claim 4 further characterized in that said keying member (12, 13, 14) has an electrically conductive, third dowel (32) extending outwardly therefrom and connected to an additional terminal pin, said face of said connector block (34) has a fluting (47) dimensioned to admit said third dowel (32) and located to correspond to the position of said third dowel (32) and in an electrical contact spring (48) positioned in said last-mentioned fluting (47) to make electrical contact with said third dowel (32) when said connector block (34) is fitted over said array of terminal pins (15).

7. Electrical interconnection apparatus comprising an array of terminal pins (15), a connector block (34) adapted to fit over said pins (15), and an electrical component (11) presenting a plate leading edge characterized in a keying member (12, 13, 14) associated with said array of terminal pins (15), said member (14) having a pair of dowels (26, 27) extending outwardly therefrom having a predetermined spacing uniquely selected from a plurality of possible spacings and in that said plate leading edge of said component (11) has a pair of notches (40, 42) formed therein spaced apart to correspond to said predetermined spacing of said pair of dowels (26, 27) and dimensioned to admit said last mentioned dowels when said connector block (34) is fitted over said array of terminal pins (15), and in that said connector block (34) is formed to present a face in contact with one side of said component (11) plate and having a plurality of flutings (43) in said face dimensioned to admit said dowels (26, 27) and spaced to correspond to said plurality of possible spacings, and further characterized in a flat stiffener member (38) having a face in contact with the other side of said component (11) plate and having a plurality of flutings (44) dimensioned to admit said dowels (26, 27) and spaced to correspond to said plurality of possible spacings.

8. Electrical interconnection apparatus as claimed in claim 7 further characterized in that said electrical component (11) comprises an electrical circuit board.

9. Electrical interconnection apparatus as claimed in claim 7 further characterized in that said keying member (12, 13, 14) has an electrically conductive, third dowel (32) extending outwardly therefrom and connected to an additional terminal pin, said face of said connector block (34) has a fluting (47) dimensioned to admit said third dowel (32) and located to correspond to the position of said third dowel (32) and in an electrical contact spring (48) positioned in said last-mentioned fluting (47) to make electrical contact with said third dowel (32) when said connector block (34) is fitted over said array of terminal pins (15).

10. In combination, an electrical component presenting a keying plate on at least one side, said plate having a first and an opposite, second face and leading edge, a connector block adapted to engage an array of backplane terminal pins, said block having a surface abutting said first keying plate face, and a stiffener plate having a surface abutting said opposite second face of said keying plate, said keying plate having a first and a second notch formed inwardly from said leading edge, said notches being spaced and located at predetermined locations on said keying plate selected from a plurality of possible fixed locations of said keying plate, said notches being dimensioned to admit a first and a second dowel correspondingly spaced associated with said array of terminal pins, said surface of said connector block having flutings formed therein dimensioned to admit said dowels, said flutings being spaced to correspond to said plurality of possible fixed locations on said keying plate, said surface of said stiffener plate having flutings formed therein dimensioned to admit said dowels and spaced to correspond to the spacings of said flutings on said surface of said connector block.

11. The combination as claimed in claim 10 in which said electrical component comprises an electrical circuit board.

* * * * *